United States Patent [19]

Kulle

[11] 3,986,017

[45] Oct. 12, 1976

[54] AUTOMOBILE HEADLIGHT

[75] Inventor: Frank Kulle, Sun City, Ariz.

[73] Assignee: Lawrence Peska Associates, Inc., New York, N.Y. ; a part interest

[22] Filed: Apr. 3, 1975

[21] Appl. No.: 564,620

[52] U.S. Cl. ..... 240/41 R; 240/11.4 R; 240/7.1 R; 240/51.12

[51] Int. Cl.[2] ..... H05B 33/00

[58] Field of Search ..... 240/11.4 R, 41 R, 41 SB, 240/7.1 R, 51.12

[56] References Cited

UNITED STATES PATENTS

| | | | |
|---|---|---|---|
| 2,392,828 | 1/1946 | Noel | 240/41 SB |
| 2,794,906 | 6/1957 | Edgerton | 240/51.12 X |
| 2,825,795 | 3/1958 | Henninger | 240/41 R |
| 2,846,565 | 8/1958 | Binkley et al. | 240/51.12 X |
| 3,297,863 | 1/1967 | Robbiano | 240/51.12 X |

*Primary Examiner*—R. L. Moses

[57] ABSTRACT

A substantially glare-free vehicle headlight is characterized by a fluorescent light emitting element.

2 Claims, 3 Drawing Figures

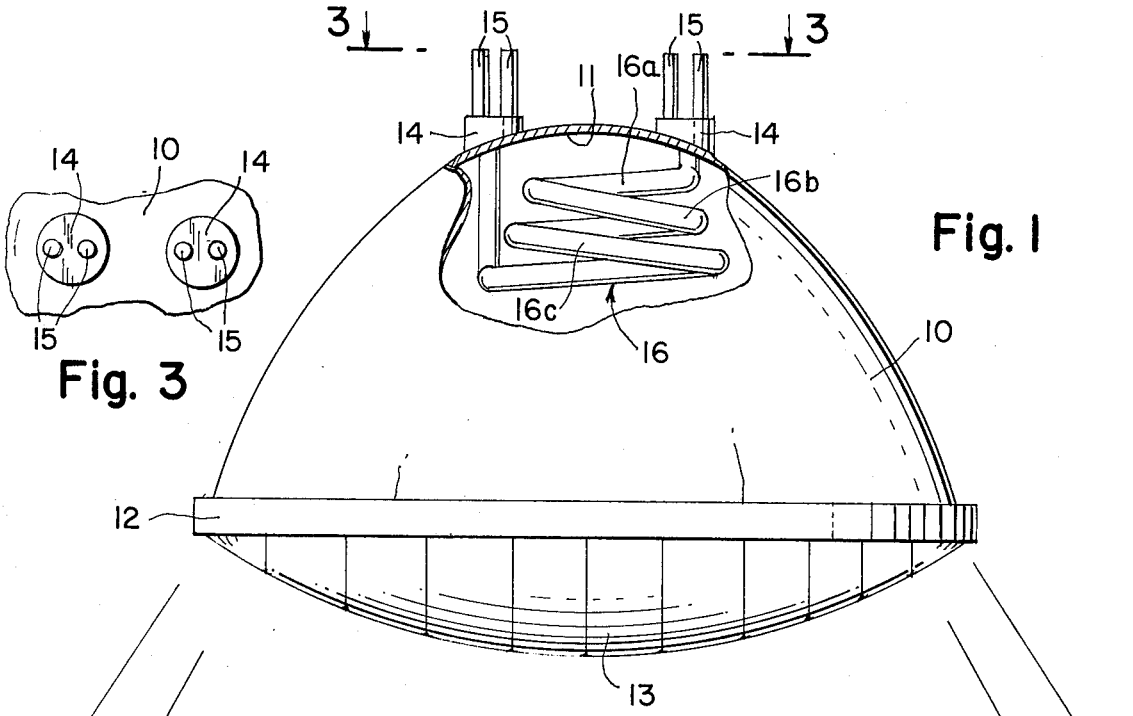
Fig. 1
Fig. 3
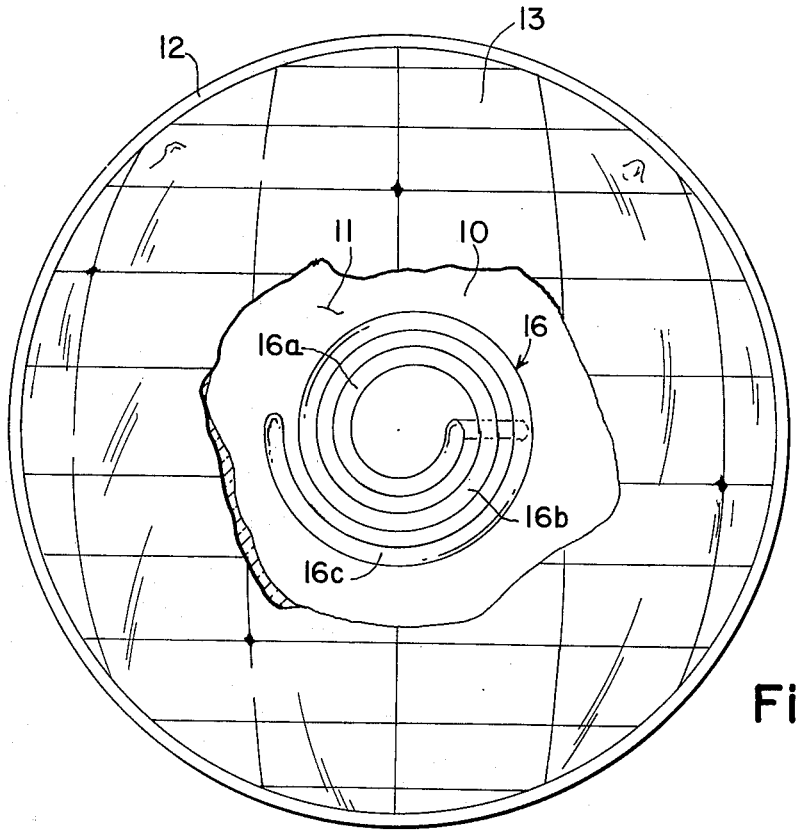
Fig. 2

AUTOMOBILE HEADLIGHT

BACKGROUND OF INVENTION

One of the most common complaints heard about night driving concerns the hazards and discomfort caused by the blinding glare of the headlights of oncoming cars and especially those whose drivers fail to deflect their headlights from high beam to low beam. Also there is incontrovertible evidence that headlight glare is an important cause of many highway accidents; and with the advent of more powerful cars and higher average driving speeds automobiles are now equiped with headlight lighting systems of increased intensity, in order to extend the range of vision, — but unfortunately also add to the problem of glare.

U.S. Pat. No. 2,822,488 describes one means used earlier to reduce glare wherein one or more glare-filters are built into a headlight housing between the lens and the conventional tungsten lamp filament — each glare-filter comprising a sealed ion chamber under partial vacuum and containing an excitable gas or vapor, the latter being energized by high voltage discharge between terminals at opposite extremities of the chamber whenever the primary light source is energized.

While it is alleged that the interposition of the ion chamber (s) between the primary light source and the lens will reduce glare with substantially no loss in illumination nevertheless the construction of a headlight with one or more sealed ion chambers each with its own terminals in addition to the conventional low voltage circuitry for energizing the primary light source presents complex and costly problems of construction not amenable to the economics of mass production technology.

It is desirable therefore to provide modern vehicles with headlights of relatively simple and inexpensive construction which will have the level of illumination required by law and at the same time be substanitally glare-free.

DESCRIPTION OF DRAWING

FIG. 1 is a plan view of an automobile headlight of this invention partially broken away to show the glare-free light emitting element.

FIG. 2 is a front elevation of the headlight of FIG. 1 with the lens partially broken away to show a front elevation of the glare-free light emitting element; and FIG. 3 is a fragmentary rear elevation of the headlight of FIG. 1 in the direction of arrows 3 — 3 of FIG. 1 showing the terminals of the glare-free light emitting element.

PREFERRED EMBODIMENT OF INVENTION

Referring now to the drawings, the vehicle headlight of this invention is preferable but not necessarily of the seal-beam type and comprises a metal or plastic reflector housing 10 having its inner surface provided with the usual reflective coating as indicated generally at 11. The housing 10 is shown as substantially parabolic but it will be understood that the housing may be eliptical, a combination of eliptic and parabolic, or of other suitable curvature, as the case may be. The front or forward edge of the housing is provided with a conventional annular flange 12 in which the annular bead of the lens 13 is secured and sealed.

The back of the reflector housing is provided with a pair of transversely spaced substantially cylindrical terminal blocks 14 — 14 which may be formed as integral protuberances on the back of the housing; or as separate elements secured thereto by welded joints or equivalent fastening means. As shown especially well in FIG. 1 each terminal block has a pair of terminal posts 15 — 15. Openings (not shown) are provided in the rear of the reflector housing opposite the respective terminal blocks to accomodate the opposite ends, respectively, of a light emitting element 16 each end of which is designed to be engaged with one of the terminal blocks and to make electrical contact with its corresponding pair of terminal posts 15 — 15.

The light emitting element 16 is a gaseous electric discharge lamp, sometimes referred to as a fluorescent tube or lamp designed, when energized, to have a candlepower equivalent to that of the tungsten filaments used in conventional headlights — but with a softer and less glaring effect.

To this end it has been discovered that by shaping the fluorescent tube in the form of a coil comprising a plurality of concentric rings or coils of progressively increasing diameter, as indicated at 16*a*, 16*b* and 16*c*, and spaced apart along the longitudinal axis of the headlight so as to form, in effect, a truncated helix with the ring or coil 16*c* of major diameter foremost, the desired level of illumination is assured but with substantially no glare. By reference to the drawings it will be seen that for a headlight of standard diameter, i.e. about 5¼ inches, the truncated helix is formed of a tube of glass or other suitable material, approximately 3/16 inches in diameter, its coils 16*a*, 16*b* and 16*c* being approximately 0.75 inch; 1.0 inch and 1.5 inches in diameter, respectively, the overall length of the truncated helix being about ¾ inches. It will be understood however that the dimensions of the fluorescent lamp 16 as well as the number of coils may be varied depending upon the particular size of the headlight in which it is to be assembled.

Energization of the fluorescent lamp 16 is by a direct current source such as a vehicle battery, and which any suitable circuitry may be employed a preferred wiring system is one wherein a high voltage lead from the coil of the vehicle DC electrical system is connected by means of a DC-AC converter, including a switch for opening and closing the circuitry, to the terminal posts 15 — 15 at one end of the fluorescent lamp 16, the terminal posts 15 — 15 of the opposite end of the lamp 16 being connected by suitable leads to the vehicle distributer.

The invention may be carried out in other specific ways than those herein set forth without departing from the spirit and essential characteristics of the invention and the present embodiment is therefore to be considered in all respects as illustrative and not restrictive, and all changes coming within the meaning and equivalency range of the appended claims are intended to be embraced therein.

I claim:

1. A substantially glare-free vehicle headlight comprising: a reflector housing, a light emitting element constructed and arranged to be mounted in said housing adjacent the rear wall thereof said light emitting element comprising a gas-filled arc discharge tube arranged in the form of a plurality of spaced apart coils, of progressively increasing diameter and having the configuration of a truncated helix, the longitudinal axis of which is substantially perpendicular to the plane of the lens, the major coil of said truncated helix being foremost in said housing, a lens arranged to be secured at the forward end of said housing, a pair of laterally spaced terminal blocks arranged to project from the rear wall of said housing, each one of the two ends of said light emitting element arranged to engage in one of said terminal blocks, and each terminal block having a pair of terminal posts for connecting said light emitting element to a source of electric energy.

2. A substantially glare-free vehicle headlight according to claim 1 wherein said truncated helix comprises three coils of a fluorescent lamp the major coil being about twice the diameter of the smallest coil of said helix.

* * * * *